United States Patent [19]

Wiseman

[11] Patent Number: 4,467,990

[45] Date of Patent: Aug. 28, 1984

[54] PEGBOARD SPACER

[76] Inventor: Robert F. Wiseman, 2800 Arguello Dr., Burlingame, Calif. 94010

[21] Appl. No.: 303,907

[22] Filed: Sep. 21, 1981

[51] Int. Cl.[3] ..... E04G 3/00

[52] U.S. Cl. ..... 248/220.3; 52/36

[58] Field of Search ..... 248/220.3, 220.4, 221.1, 248/221.2, 205.3; 211/87; 52/36

[56] References Cited

U.S. PATENT DOCUMENTS

| | | | |
|---|---|---|---|
| 2,685,178 | 8/1954 | Eck | 248/635 X |
| 2,723,815 | 11/1955 | Browning | 248/205 A |
| 2,988,315 | 6/1961 | Saxe | 248/223 |
| 3,094,892 | 6/1963 | Topf | 248/220.3 X |
| 3,193,231 | 7/1965 | Curry | 248/221.1 |
| 3,235,218 | 2/1966 | Graham | 248/225 |
| 3,258,237 | 6/1966 | Beiman | 248/225 |
| 3,300,173 | 1/1967 | Kennedy | 248/205.3 |
| 3,311,338 | 3/1967 | Culley | 248/205.3 |
| 3,339,871 | 9/1967 | Larson | 248/225 |
| 3,424,421 | 1/1969 | Kalbow et al. | 248/220.4 X |
| 3,715,096 | 2/1973 | Filbert | 248/223 |
| 3,828,495 | 8/1974 | Law | 52/36 |
| 3,941,343 | 3/1976 | Kennedy | 248/220.3 |
| 4,086,978 | 5/1978 | Clements | 52/36 X |
| 4,231,197 | 11/1980 | Caplan | 52/36 |

FOREIGN PATENT DOCUMENTS

| | | | |
|---|---|---|---|
| 824358 | 10/1969 | Canada | 248/220.3 |
| 12155 | 1/1979 | Japan | 248/635 |

*Primary Examiner*—J. Franklin Foss

*Attorney, Agent, or Firm*—Schapp and Hatch

[57] ABSTRACT

A PEGBOARD spacer for maintaining a perforated PEGBOARD a desired distance from a mounting surface such as a wall or the like. In one form of the invention, a plurality of individual spacers are provided, each spacer being of cup-shape and having an axially extending opening through the bottom of the cup adapted to receive the shank of a mounting bolt or screw. Means is provided for detachably securing the spacer member to the rear side of the PEGBOARD in alignment with a perforation through the PEGBOARD. Such means may comprise either a collar extending axially from the bottom of the cup and sized to provide a press fit with the perforation in the PEGBOARD, or a pressure sensitive adhesive. In another form of the invention, the spacer member is in the form of an elongated channel, the web of which may be frangible for providing openings at desired locations therealong.

4 Claims, 6 Drawing Figures

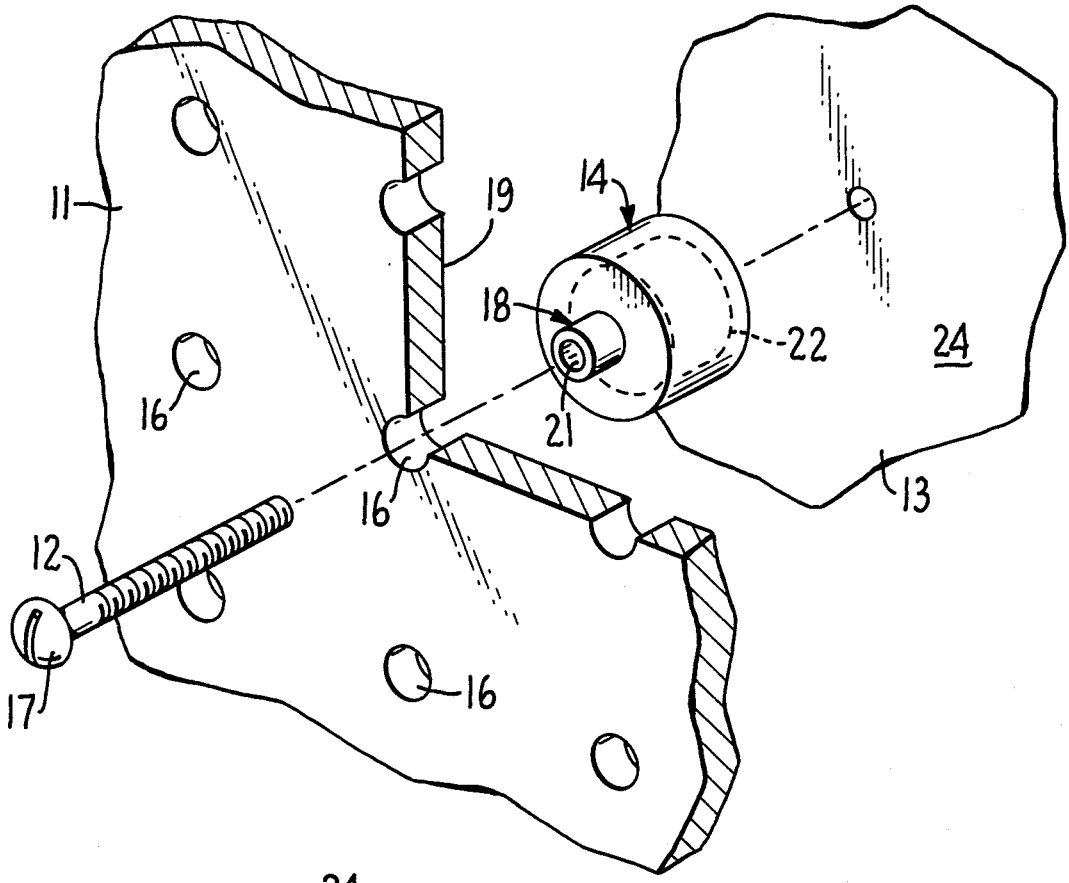
FIG. 1.
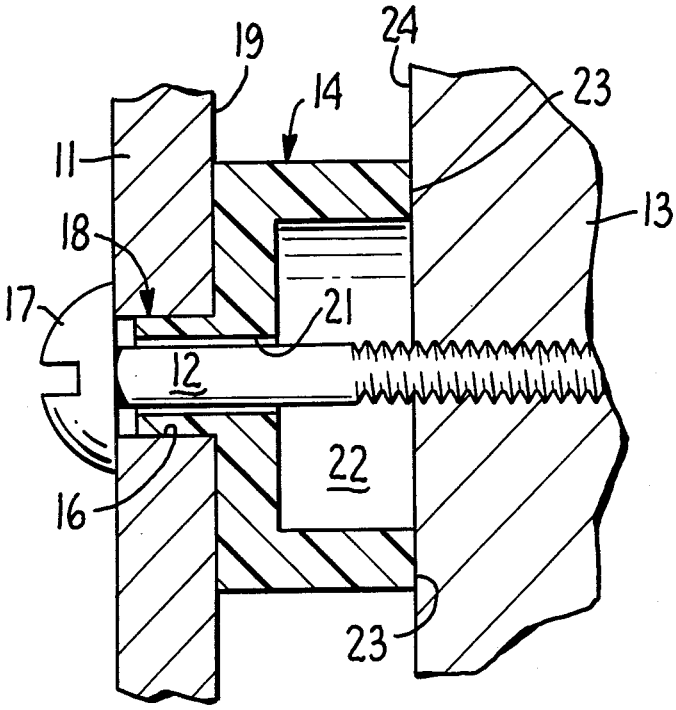
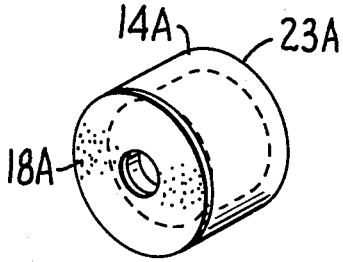
FIG. 3
FIG. 2.

PEGBOARD SPACER

BACKGROUND OF THE INVENTION

1. Field of the Invention

This invention relates to the mounting of pegboards having rows of perforations, and more particularly to devices for holding the pegboards in desired spaced relation to the walls or the like upon which they are mounted.

2. Description of the Prior Art

Pegboards, usually a sheet of masonite approximately ⅛" thick and provided with plural rows of 3/16" perforations on one inch centers, have come into widespread use because they offer a convenient way to hang up tools, displays and a wide variety of objects. The various items are removably mounted on hooks and other supports formed of thin cylindrical rod or wire having an end formed for removable insertion through the perforations. Normally, the pegboards are mounted in spaced relation to a wall or the like, usually about ⅜" from the wall, to leave room for the hanger hooks to pass through the perforations and engage the rear side of the PEGBOARD. Conventionally, the pegboards are secured by nails or screws to furring strips which, in turn, are secured to the wall by screws, bolts, blind bolts or the like. The furring strips are awkward to place and require several installation steps before the PEGBOARD itself can be mounted.

Attempts have heretofore been made to replace the furring strips with individual spacers which can be located at each of the perforations through which the PEGBOARD mounting screws or bolts are to be engaged. Typical of these is U.S. Pat. No. 3,424,421 to Kalbow et al. which discloses a cylindrical spacer having a hole through the middle. To install the PEGBOARD, it is necessary to position the bolts or screws through the PEGBOARD perforations, then position the spacers on the bolts or screws, and finally pass the ends of the bolts or screws through openings in the wall. This is extremely difficult, because it is almost impossible for a single installer to see the multiple ends of the bolts and screws and align them with pre-drilled holes.

Another approach to the problem of providing a spacer is illustrated in U.S. Pat. No. 2,988,315 to Saxe. This patent shows a cup-shaped spacer in which the cup is frusto-conical in shape and opens outwardly from the wall, the mounting screw passing through the base of the cup remotely from the PEGBOARD.

SUMMARY OF THE INVENTION

The spacer of the present invention greatly reduces installation problems, and is versatile in use. The spacer self-adheres to the backside of the PEGBOARD in position for the mounting bolts and screws to pass through the spacer before entering the wall. Because of this self-adherence feature, the PEGBOARD and its spacers form a unitary assembly which is easily handled and installed.

Removable adherence of the spacer to the PEGBOARD in accordance with the invention is provided by pressure sensitive adhesive or, in another form of the invention, by a collar surrounding the hole in the spacer and extending therefrom; this collar being formed to have a press fit into one of the perforations in the PEGBOARD.

For relatively light duty installations, individual spacers are provided, and for lightness in weight, the spacers may be hollowed out to a cup-like shape, with the rim of the cup engaging the wall.

For heavier duty installations, the spacers are provided in the form of elongated strips which serve the dual purpose of (1) providing the desired spacing of the PEGBOARD from the wall and (2) stiffening the PEGBOARD against sagging, bending or twisting under heavy loads imposed on the PEGBOARD hooks. For lightness in weight, the elongated strips may be hollowed out to provide a channel shape and, to increase adaptability, the transverse web of the channel may be made frangible so that openings for the mounting bolts or screws may be made at any desired point therealong.

It is therefore an object of the present invention to provide a device for spacing pegboards from a wall or the like which adapted for easy and ready detachable mounting on the rear side of the pegboard so as to provide a unitary assembly therewith.

Another object of the present invention is to provide a spacing device of the character described which is self adhering to the reverse side of the pegboard at any desired position.

A further object of the present invention is provide a spacing device of the character described which provides the dual function of reinforcing the pegboard against bending, twisting or sagging, in additional to providing the desired spacing from the wall on which the PEGBOARD is mounted.

Other objects and features of advantage will become apparent as the specification progresses and from the claims.

BRIEF DESCRIPTION OF THE DRAWINGS

FIG. 1 is a an exploded perspective view of a device for spacing pegboards from a wall or the like shown in operative association with a mounting bolt and fragmentary portions of a PEGBOARD and a wall.

FIG. 2 is a longitudinal cross sectional view on an enlarged scale of the structures of FIG. 1, shown in assembled condition.

FIG. 3 is a perspective view of a modified form of the PEGBOARD spacing device of FIG. 1.

Figure 4:
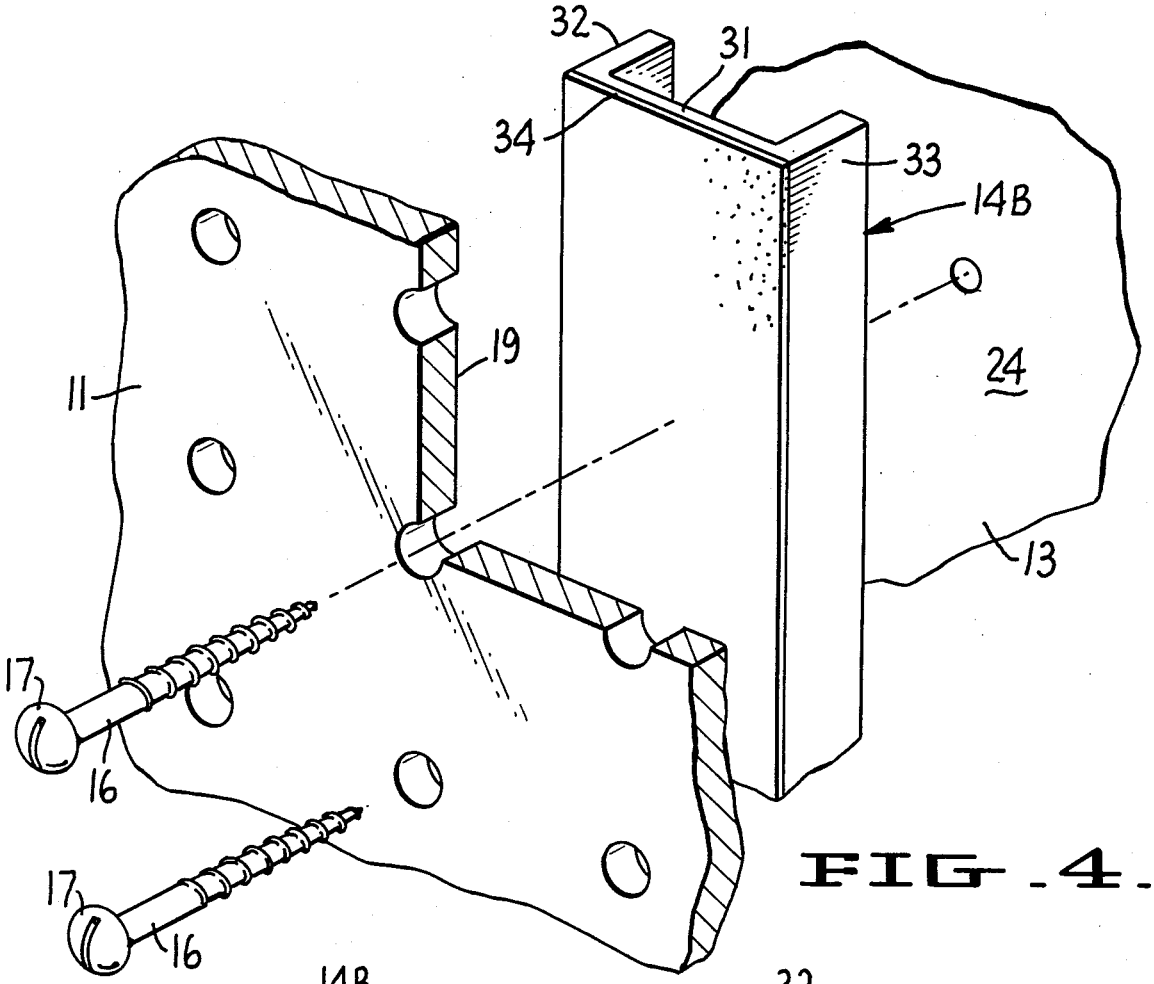
FIG. 4 is an exploded perspective view of another form of the invention illustrating an elongated spacing member in operative association with a pair of mounting bolts and fragmentary portions of a PEGBOARD and a wall upon which it is to be mounted.

While only the preferred forms of the invention are illustration in the drawings, it will be apparent that various modifications could be made without departing from the ambit of the claims.

DESCRIPTION OF THE PREFERRED EMBODIMENTS

As may be seen in the accompanying drawings, a conventional PEGBOARD 11 is secured by means of a mounting member such as a screw or bolt 12, to a wall or the like 13, the PEGBOARD 11 being held in desired spaced relation to wall 13 by a spacing member 14. The bolt 12 passes through one of the perforations 16 formed in the PEGBOARD, or through a special perforation drilled for that purpose. Normally, the head 17 of bolt or screw 12 spans the perforation 16 in the manner shown in FIG. 2 of the drawings, to hold the PEGBOARD securely to the wall.

In accordance with the present invention, the spacing member 14 is provided with means 18 formed for releasably securing the spacer member 14 to the rear side 19 of the PEGBOARD 11 with an opening 21 through member 14 in coaxial alignment with the perforation 16 in PEGBOARD 11 through which the mounting member 12 passes.

As shown in FIG. 1 and 2 of the drawings, the spacing member 14 is generally cylindrical in shape with the opening 21 extending axially there through, and with the means 18 being provided by a collar extending from the spacer member 14 in coaxial alignment with the opening 21, the collar being formed for press fit engagement in the perforation 16 in the PEGBOARD 11 for releasably securing spacing member 14 to the rear side 19 of the PEGBOARD.

The spacing member 14 may be made of any suitable material, but preferably is formed of a slightly resililent plastic so that the collar 18 will engage securely, but removably, in the perforation 16. Also for lightness of weight and economy, the spacing member 14 is hollowed out at 22 to provide a cup shape, with the rim 23 of the cup engaging the face 24 of wall 13.

In the form of the invention illustrated in FIG. 3, the means 18A on the member 14A formed for releasably securing member 14A to the rear side 19 of the PEGBOARD 11 consists of a pressure sensitive adhesive on the bottom face of the cup shaped member 14A rather than the collar 18 illustrated in FIG. 1 and 2 of the drawings. Similar pressure sensitive adhesive may be provided on the rim 23A of cup shaped spacing member 14A to assist in holding the PEGBOARD and spacer assembly in place during the mounting procedures.

Figure 5:
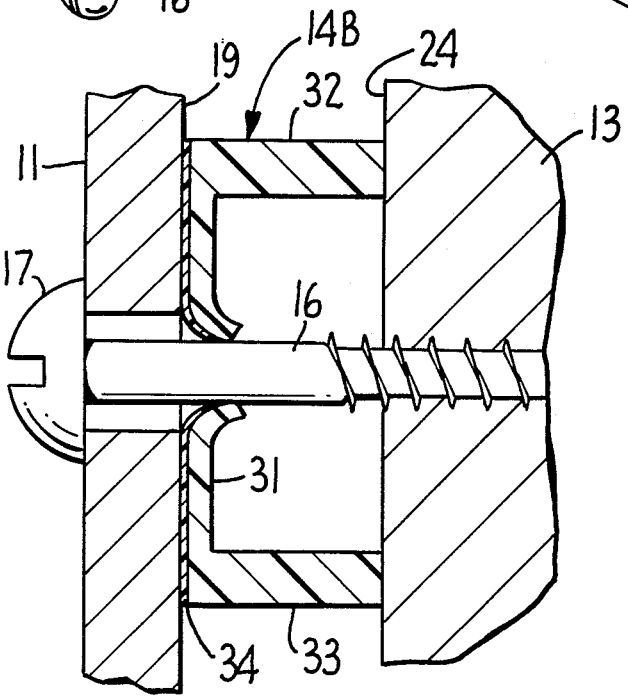
FIG. 5 is a cross sectional view on an enlarged scale taken through the elongated spacing member of FIG. 4 at one of the mounting bolts, and showing the parts in mounted position.
Figure 6:
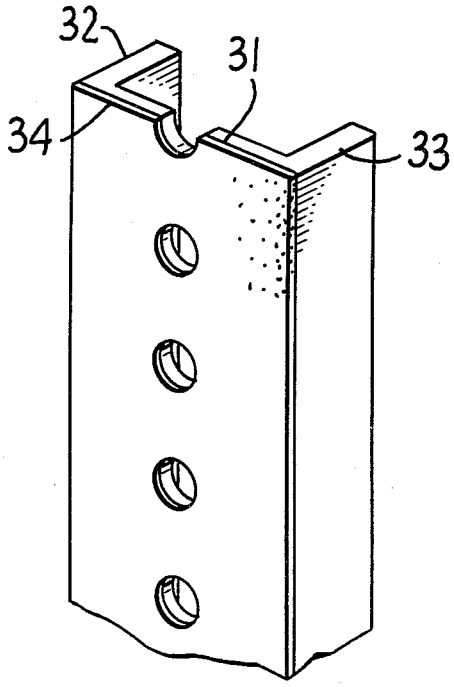
FIG. 6 is a perspective view of fragmentary portions of a modified form of the elongated spacer member of FIG. 4.

In accordance with the present invention, the spacing members may be adapted to serve the dual purpose of reinforcing the PEGBOARD against bending and sagging, as well as performing the described spacing function. A spacer member 14B modified for this purpose is illustrated in FIGS. 3 through 6 of the drawings. As there shown, the spacing member 14B is elongated and is stiff enough, when secured to the rear side 19 of PEGBOARD 11, to prevent sagging and bending of the PEGBOARD under heavy loads. The spacer strips 14B may be installed horizontally, vertically, diagonally, or a combination of same as required to perform the desired stiffening function.

Although the spacer strips 14B may be of solid rectangular cross section, the strips 14B are preferably of U-shaped or channel cross section providing a central web 31 joining generally parallel side flanges 32 and 33. Also, while means similar to the collars 18 may be provided on strips 14A for securing same to the rear side 19 of the PEGBOARD 11, in order to achieve the stiffening or reinforcing function, it is preferred to utilize a layer of pressure sensitive adhesive 34 on the bottom of the web 31. Similar pressure sensitive adhesive may be provided on the outer edges of the flanges 32 and 33 to assist in holding the PEGBOARD and spacer assembly in position against the wall face 24 during installation.

In order to permit the described positioning of the spacer strips 14B either horizontally, vertically or at an angle, I prefer to make the web 31 flangible enough so that openings for the mounting elements 12 may readily be punched through the web at any desired location therealong. While the spacer strips 14B may be made of any suitable material, for reasons of the economy, strength and easy cuttability, the mounting strips 14B are preferrably provided in the form of an extruded plastic channel having the described properties.

From the foregoing, it will be apparent that the spacing devices and PEGBOARD assembly of the present invention provides a simple, sturdy and easily installable PEGBOARD spacer mounting which is also capable of reinforcing the PEGBOARD against bending, sagging or twisting under heavy loads.

I claim:

1. A device for spacing pegboards from a wall or the like, comprising a member having a thickness equivalent to the desired spacing of the PEGBOARD from the wall and formed for providing an opening through said member sized to accomodate the shank of a mounting element chosen from the class of screws, nails and bolts, and means on said member formed for releasably securing said member to the rear side of the PEGBOARD prior to installation of said PEGBOARD with said opening in alignment with a perforation in said PEGBOARD through which said mounting element passes, said means comprising a collar extending from said member in coaxial alignment with said opening and formed for press fit engagement in a perforation in said PEGBOARD for releasably securing said member to the rear side of said PEGBOARD.

2. A PEGBOARD assembly, comprising a sheet of material having a plurality of rows of perforations therethrough, a plurality of spacing members having a thickness equivalent to the desired spacing of said PEGBOARD from a body providing a flat mounting surface, attaching means releasably securing said spacing members to the rear side of said pegboard prior to installation of said PEGBOARD, each of said spacing members having an opening therethrough aligned with a perforation in said PEGBOARD, and an elongated mounting element adapted for securing to said body passing through each of said aligned openings and perforations and having an enlarged retaining head at the front of said PEGBOARD, said attaching means comprising an extension on said spacing member formed for press fit engagement in a perforation of said PEGBOARD.

3. A PEGBOARD assembly as described in claim 2, and wherein said spacing member is generally cylindrical about said opening, and a raised collar extends from a flat end face of said spacing member coaxially with said opening, said collar being formed to provide said extension.

4. A PEGBOARD assembly as described in claim 3, and wherein said spacing member and extension are unitarily formed of resilient plastic, and said spacing member is hollowed out on the end opposite said collar to define a cup shape.

* * * * *